US007997418B2

(12) United States Patent
Löffler et al.

(10) Patent No.: US 7,997,418 B2
(45) Date of Patent: Aug. 16, 2011

(54) METHOD AND DEVICE FOR PROCESSING UNITS OF MONEY

(75) Inventors: Lukas Löffler, Deisenhofen (DE); Rudolf Öttl, München (DE); Josef Geier, München (DE)

(73) Assignee: Giesecke & Devrient GmbH, Munich (DE)

( * ) Notice: Subject to any disclaimer, the term of this patent is extended or adjusted under 35 U.S.C. 154(b) by 1586 days.

(21) Appl. No.: 10/363,864

(22) PCT Filed: Sep. 13, 2001

(86) PCT No.: PCT/EP01/10605

§ 371 (c)(1),
(2), (4) Date: Oct. 14, 2003

(87) PCT Pub. No.: WO02/02349

PCT Pub. Date: Mar. 21, 2002

(65) Prior Publication Data

US 2004/0050649 A1 Mar. 18, 2004

(30) Foreign Application Priority Data

Sep. 15, 2000 (DE) ..... 100 46 082

(51) Int. Cl.
*G07F 7/00* (2006.01)
*B07C 5/00* (2006.01)

(52) U.S. Cl. ..... 209/534; 194/206; 194/207; 235/379

(58) Field of Classification Search ..... 209/534; 453/191; 194/206, 207; 902/15; 235/379
See application file for complete search history.

(56) References Cited

U.S. PATENT DOCUMENTS

| | | | | | |
|---|---|---|---|---|---|
| 4,321,671 | A | * | 3/1982 | Ohsako | 705/43 |
| 4,362,112 | A | * | 12/1982 | Uchida | 109/19 |
| 4,363,584 | A | * | 12/1982 | Kokubo | 414/788.5 |
| 4,465,192 | A | | 8/1984 | Ohba et al. | |
| 4,578,009 | A | * | 3/1986 | Granzow et al. | 414/789.9 |
| 4,653,647 | A | * | 3/1987 | Hashimoto | 209/534 |
| 4,691,910 | A | * | 9/1987 | Cargill et al. | 271/3.15 |
| 4,694,963 | A | * | 9/1987 | Takesako | 209/534 |
| 4,830,742 | A | | 5/1989 | Takesako | |
| 4,962,919 | A | * | 10/1990 | Azuchi et al. | 271/3.01 |
| 5,436,435 | A | * | 7/1995 | McMillan | 235/379 |
| 5,606,157 | A | | 2/1997 | Awatsu et al. | |
| 5,804,804 | A | * | 9/1998 | Fukatsu et al. | 235/379 |

(Continued)

FOREIGN PATENT DOCUMENTS

EP 0 753 524 A2 1/1997

(Continued)

*Primary Examiner* — Joseph C Rodriguez
(74) *Attorney, Agent, or Firm* — Bacon & Thomas, PLLC

(57) ABSTRACT

The invention relates to a method and a device for processing monetary units such as banknotes or coins, in which the monetary unit are conveyed from an input compartment in each case to one of a plurality of output compartments as a function of predefined sorting criteria.

In order to widen the range of application of banknote sorting machines, a control device for the processing apparatus is provided, which control device is configured to be able to output in each case a predefined number of monetary units of a plurality of different denominations into at least some of the output compartments in order to process these monetary units in an individualized fashion. In comparison to the previously predominantly manually executed individualized processing, the solution according to the invention permits rapid and reliable individualized processing of cash supported by automatic means.

2 Claims, 1 Drawing Sheet

U.S. PATENT DOCUMENTS 5,909,502 A * 6/1999 Mazur ..... 382/135
6,278,795 B1 * 8/2001 Anderson et al. ..... 382/135
6,351,551 B1 * 2/2002 Munro et al. ..... 382/135
6,397,565 B2 * 6/2002 Ohshita ..... 53/501
6,398,000 B1 * 6/2002 Jenrick et al. ..... 194/200
6,507,769 B2 * 1/2003 Urata et al. ..... 700/223
6,520,408 B1 * 2/2003 Force et al. ..... 235/379
6,715,670 B1 * 4/2004 Swiatek et al. ..... 235/379

FOREIGN PATENT DOCUMENTS

EP 0 962 895 A1 12/1999
EP 1 035 520 A 9/2000

* cited by examiner

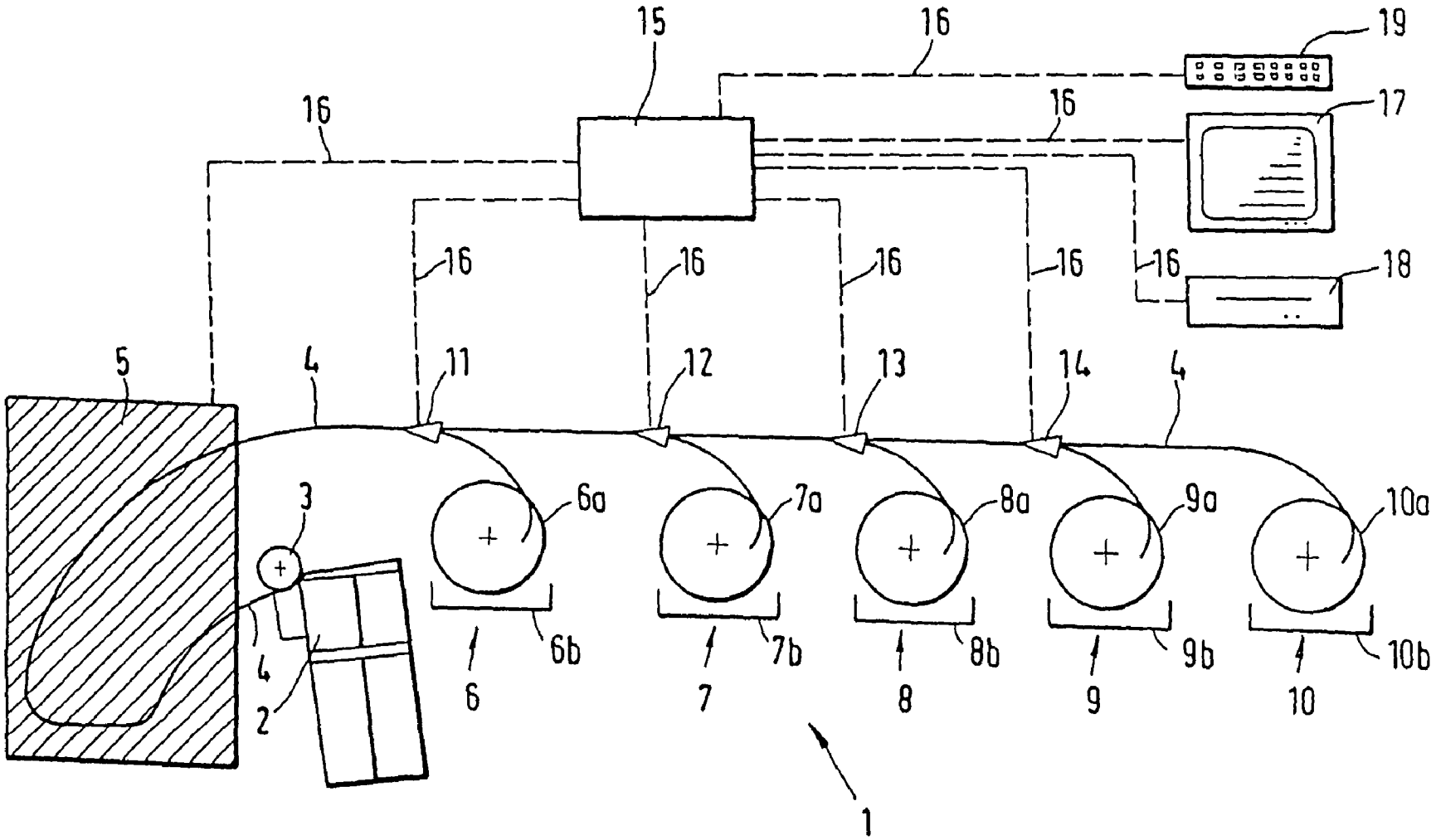
19
17
18
16
15
10a
10b
10
9a
9b
9
8a
8b
8
7a
7b
7
6a
6b
6
14
13
12
11
4
3
2
5
1

METHOD AND DEVICE FOR PROCESSING UNITS OF MONEY

BACKGROUND

The invention relates to a method and a device for processing monetary units such as banknotes or coins, in which the monetary unit are conveyed from an input compartment in each case to one of a plurality of output compartments as a function of predefined sorting criteria.

Such a method and such a device are known, for example, from DE 34 12 726 C2 or DE 44 37 722 A1. Here, bundles of banknotes are input into an input compartment, separated and conveyed past a checking device by means of a conveying device. The separated banknotes are checked by sensors of the checking device and fed to specific output compartments as a function of the checking result.

If a bundle of banknotes is inserted with mixed denominations, in order to process the banknotes for depositing purposes, they are usually sorted in such a way that only banknotes of a single denomination are ever stored in one output compartment. For example, a first output compartment can be used to hold the banknotes of a first denomination and a second output compartment to hold the banknotes of a second denomination from the mixed bundle of banknotes which has been inserted.

The number of banknotes to be stacked in the individual output compartments may be preset in a variable fashion here. This presetting is desired, for example, if stacks with a predetermined number of banknotes are required for subsequent wrapping.

Using a counting device, the banknotes which are stored in the individual output compartments are counted and the conveying of banknotes to the output compartments is interrupted if the predefined number of banknotes has been reached in at least one of the output compartments, with the result that the associated stack can be removed for subsequent wrapping.

Although these known banknote processing systems can reliably and safely carry out these functions, it is desired to expand further the application spectrum of such systems.

SUMMARY

The object of the present invention is therefore to make available a method and a device for processing monetary units such as banknotes or coins, which are suitable for further applications.

Although the method according to the invention and the devices according to the invention can also be used for processing monetary units such as coins, particular advantages are obtained for the processing of banknotes, which will be described below by way of example.

The present invention is based on the knowledge that banknote processing systems can also be used for carrying out individualized processing of banknotes supported by automatic means by virtue of the fact that in each case a predetermined number of banknotes of a plurality of different denominations are output into at least some of the output compartments of the apparatus.

Individualized processing is to be understood here as meaning that in each case a desired number of banknotes of different denominations are collected together for various users such as counter clerks or people working at cash desks in banks or in commerce.

This individualized processing was previously largely carried out manually. To do this in a bank, for example, different individual bundles of banknotes were manually collected together by an assigned person for each individual counter clerk, which bundles could contain a predefined number of banknotes of each of the different denominations.

This known process of manual individualized processing is however very time-consuming and prone to errors.

By supporting this individualized processing by automatic means using the method according to the invention and the device according to the invention, more rapid and reliable individualized processing is made possible with a high processing speed and reliable counting.

Whereas known banknote processing systems are used to sort or separate off the banknotes of the individual denominations from a bundle with mixed denominations into respective separate stacks, the solution according to the invention makes it possible to widen the customary application spectrum.

Therefore, mixed bundles are not separated according to their denomination but rather banknotes which have been separated beforehand according to their denomination can be collected into bundles which contain a predefined and variable number of banknotes of each of the individual denominations, in order to be able to carry out individualized processing for a plurality of users such as counter clerks or the like.

A further particular advantage of the present invention is that it is possible also to retrofit already known banknote processing machines, for example the system from the applicant which is known by the product name "BPS 200", using software in order to implement the features which are essential to the invention. This makes it possible to manufacture the systems cost-effectively.

BRIEF DRAWING DESCRIPTION

The invention is described in more detail below; firstly an embodiment of the device according to the invention and one of the method according to the invention are explained with reference to the appended single FIGURE, and then some of the possible variations of these exemplary embodiments are explained.

DETAILED DESCRIPTION OF VARIOUS EMBODIMENTS

The FIGURE shows a schematic view of an embodiment of an apparatus according to the invention for processing banknotes, said apparatus being designated in its entirety by the reference number 1. The apparatus 1 contains, in a fashion known per se, the following components. An input compartment 2 for inputting a stack of banknotes and a separator 3 for separating the stack of banknotes held in the input compartment 2 in order to input an individual banknote into the conveying system 4 that is connected to the separator 2.

The conveying system 4 leads through a checking device 5 in which the notes are checked. The checking device 5 contains sensor units (not illustrated) in order to check, for example, the denomination of the banknotes and their authenticity.

The conveying system 4 is constructed in such a way that the banknotes which have passed through the checking device 5 can be fed to one of a plurality of depositing devices 6, 7, 8, 9, 10. For this purpose, in the conveying path 4 there are a plurality of diverters 11, 12, 13, 14 for diverting the separated banknotes in the direction of one of the five depositing devices 6, 7, 8, 9, 10.

The depositing devices 6, 7, 8, 9, 10 can be formed from spiral compartment stackers which are known per se. The spiral compartment stackers have rotating units 6*a*, 7*a*, 8*a*, 9*a*, 10*a* with compartments which are arranged in the form of a spiral and into which the banknotes are fed by the conveying system 4 by switching the associated diverters 11, 12, 13 and 14. The individual spiral compartment stackers also contain removal devices (not illustrated) which engage in the rotating units in order to remove the banknotes from the individual compartments and deposit and stack them in the respective output compartments 6*b*, 7*b*, 8*b*, 9*b* and 10*b*.

Furthermore, the apparatus 1 comprises a control unit 15 which is connected, inter alia, to the checking device 5, the individual diverters 11, 12, 13, 14, an input unit 19, a display monitor 17 and a printer 18, by means of the signal lines 16 (illustrated schematically as dashed lines).

The control device 15 is configured here in such a way that it can evaluate the signals of the various sensor units of the checking device 5 and check them for compliance with predefined criteria. So that a separated-off banknote which is located in the conveying system 4 and has passed through the checking device 5 can be output into one of the output compartments 6*b*, 7*b*, 8*b*, 9*b*, 10*b*, the control device 15 can additionally switch the diverters 11, 12, 13, 14 arranged in the conveying path 4 as a function of the checking device 5.

The apparatus 1 according to the invention is characterized in particular by the design of the control device 15 which is specified below. By means of software settings, the control device 15 is configured in such a way that it switches the diverters 11, 12, 13, 14 in such a way that in each case a predefined number of banknotes of a plurality of different denominations can be output into at least some of the output compartments 6*b*, 7*b*, 8*b*, 9*b*, 10*b* in order to carry out individualized processing of the banknotes supported by automatic means.

As the apparatus 1 according to the invention can be used for carrying out the method according to the invention, the functional configuration of the control device 15 can be understood best with reference to the description below of an exemplary embodiment of the method according to the invention.

The entire process for the individualized processing according to this embodiment is divided essentially into three sections.

In a first section, the units to be processed in an individualized fashion are defined. For this purpose, a software module (not illustrated) of the control unit 15 can be used to assign to each output compartment 6*b*, 7*b*, 8*b*, 9*b*, 10*b* of the apparatus 1 a specific identifier which identifies, as features, the intended receiver, for example the identification number of the respective counter clerk, as well as the desired number of banknotes of each denomination.

This data can be input by the operator himself using the input keypad 19 into a database of the control unit 15 as features of the identifier of the output compartment, for an individualized processing operation which, for example, follows immediately.

By way of example it will be assumed that the operator wishes to process predefined amounts of banknotes in an individualized fashion using the apparatus 1 for three counter clerks. The first two counter clerks are assumed to respectively require, for example, seventy 50 DM notes and fifty 100 DM notes, and the third counter clerk is assumed to require sixty 50 DM notes and forty 100 DM notes.

In this case, the operator will therefore make an input into the database of the software module of the control device 15 which indicates that the first output compartment 6*b* is assigned an identifier which identifies the counter clerk and also defines that this counter clerk requires a number of seventy notes of the first denomination of 50 DM and fifty notes of the second denomination of 100 DM.

In analogous fashion, the second output compartment 7*b* is assigned, as features of the identification, the fact that the banknotes which are output during the following individualized processing operation are intended for the second counter clerk, and said employee also requires seventy 50 DM banknotes and fifty 100 DM banknotes.

Finally, the third output compartment 8*b* is assigned, as identifier, the features that the following individualized processing output is intended for the third counter clerk, and said employee requires sixty 50 DM notes and forty 100 DM notes.

For the purpose of monitoring, this data, i.e. the assignment of the individual output compartments to specific users and the outputting of the number of desired banknotes per denomination is displayed on the monitor 17 for the operator.

In the present case, three of the five output compartments 6*b*, 7*b*, 8*b*, 9*b*, 10*b* which are present are consequently required for the individualized processing for three counter clerks, i.e. one for each counter clerk. Of the remaining two output compartments 9*b*, 10*b*, one is used as a reject compartment into which excess banknotes are output which are not stored in the individual output compartments 6, 7, 8 for individualized processing.

For example, it is assumed that the software module of the control device 15 is configured in such a way that the output compartment 10*b* which is the last in the course of the conveying system 4 is to be such a reject compartment. In this case, the remaining output unit 9 does not have any function so that during the following individualized processing operation no banknotes are diverted into the respective output compartment 9*b*.

After this data has been input into the database of the control unit 15 by inputting 19 via a keyboard, a memory of the control device 15 thus contains the information on the assignment of the first three output compartments 6*b*, 7*b*, 8*b* to the individual counter clerks with the specification of the desired number of banknotes per denomination per output compartment and a specification relating to the use of the fifth compartment 10*b* as a reject compartment.

After this first preparation step has been concluded, the second step of the method according to the invention follows, in which step the sorting of the banknotes into the individual output compartments as a function of the identifier assigned in step 1 is carried out.

The operator is requested here to insert banknotes of the first required denomination. In the case of the individualized processing for three counter clerks, which is described by way of example, this will be assumed to be, for example, 50 DM banknotes.

After the 50 DM notes have been inserted into the input compartment 2, they are separated by the separator 3 and led through the checking device 5 by means of the conveying system 4. In the checking device 5, the separated banknotes are checked for their denomination and their authenticity. In addition, the separated banknotes are counted in the checking device 5.

The number of the 50 DM notes which have been found to be genuine, which has been specified in step 1 in the respective identifier of the output compartments, is then diverted into the individual output compartments 6*b*, 7*b*, 8*b*. The banknotes are diverted here by actuating the diverters 11, 12, 13, 14 using the control device 15.

For example, the diverter 11 is actuated first in such a way that the first seventy 50 DM notes which are input into the input compartment 2 are diverted into the output compartment 6*b*. As mentioned, the banknotes can already be counted in the checking device 5 in order to determine whether a sufficient number of 50 DM banknotes has already been output into the output compartment 6*b*. If the predetermined number of seventy 50 DM banknotes has already been deposited in the first output compartment 6*b* which was configured for the first counter clerk, the control unit 5 will switch over the diverter 11 in such a way that the following separated 50 DM banknotes which have been detected as being authentic are conveyed to the second diverter 12.

By correspondingly switching the diverter 12, these further 50 DM notes are then individually deposited in the second output compartment 7*b* which is intended for the second counter clerk until seventy 50 DM notes are also stacked in this compartment, as has been assigned beforehand by the operator as an identifier for this output compartment.

The diverter 12 is then switched over and the following 50 DM notes which have been separated out from the input compartment 2 are diverted into the third output compartment 6*b* which is intended for the third counter clerk. The desired previously specified number of 50 DM notes, i.e. in this case sixty 50 DM notes, is then also output into this compartment.

After the previously determined number of 50 DM notes has as a result been output into each of the output compartments 6*b*, 7*b*, 8*b*, the 50 DM banknotes which are possibly still present in the conveying system or in the input compartment 2 are diverted, by switching the diverters 13, 14, to the output compartment 10*b* which serves as a reject compartment.

This makes possible a situation in which excess banknotes do not remain in the conveying system 4, and in addition the operator is not forced to count himself in advance precisely the number of banknotes (for example $2\times70+1\times60=200\times50$ DM banknotes) which are required for the individualized processing, and input precisely this number of banknotes into the input compartment 2.

If the operator has not originally inserted sufficient 50 DM banknotes into the input compartment 2, they can be requested, for example, for further inputting via a special indicator until a sufficient number, i.e. the predetermined number, of banknotes has been sorted into the specific output compartments 6*b*, 7*b*, 8*b*.

Then, the same procedure is adopted with the further denominations. In the case described by way of example, 100 DM notes are thus inserted into the input compartment 2 by the operator and the number predefined by the identifier is also output into each of the individual output compartments 6*b*, 7*b*, 8*b* in the fashion described above.

After the desired number of, firstly, the 50 DM banknotes and then the 100 DM banknotes have been deposited in the output compartments 6*b*, 7*b*, 8*b*, the individualized processing run is terminated.

Then, seventy 50 DM notes and fifty 100 DM notes are respectively located in the first two output compartments 6*b* and 7*b* and sixty 50 DM notes and forty 100 DM notes are located in the third output compartment 8*b*.

After the banknotes have thus been individually processed in the desired fashion into the individual output compartments 6*b*, 7*b*, 8*b*, they can then be removed from the output compartments 6*b*, 7*b*, 8*b* in a third step, either automatically or else manually for further use, i.e. to be passed on to the specified receiver (counter clerk).

For example, the banknotes are removed manually from the output compartments here and intermediately stored in a film package or the like until they are handed over to the previously specified counter clerk. In order to facilitate a precise assignment to the respective receiver, the printer 18 is connected to the control device 15, said printer 18 printing out a label with the feature data of the identifier for each of the individual output compartments.

That is to say that if the operator removes, for example, the stack of seventy 50 DM banknotes and fifty 100 DM banknotes from the first output compartment 6*b* for intermediate storage for the first counter clerk, the operator will use a storage container, for example the film packaging, to intermediately store these banknotes, on which packaging a label is already attached automatically, or manually by the operator, on which, inter alia, this identifying data i.e. user and number of banknotes per denomination, is printed for the purpose of unambiguous identification.

After all the output compartments have been emptied in this way, the individualized processing operation is terminated in accordance with this embodiment of the method according to the invention.

Only one preferred exemplary embodiment of a device according to the invention or of the method according to the invention has been described above, but of course numerous variations are also conceivable, a few of these being described below by way of example.

One advantageous variation consists in the fact that not only one input compartment but rather a plurality of input compartments may be present in the device, and these are connected to the individual output compartments 6*b*, 7*b*, 8*b*, 9*b*, 10*b* via the conveying system 4 with the associated diverters 11, 12, 13, 14. In this case, it would be possible for banknotes of each of the individual denominations to be stored as a supply, i.e. stacked, in a separate input compartment so that, during the individualized processing operation, there is no need for the operator himself to have to insert the banknotes of each of the individual denominations separately into the single input compartment present in the embodiment described above.

The definition mentioned above of which output units are to be used for which purpose, i.e. the assignment specifying that the first three compartments 6*b*, 7*b*, 8*b* are used for the individualized processing and the compartment 10*b* is used as a reject compartment, is not restricted to this configuration alone but rather could also be selected differently.

If, for example, cash is to be processed in an individualized fashion for six counter clerks instead of three, it would also be possible to define, during the first step of the preparation in the control unit 15, that in a first individualized processing operation in each case a desired amount of cash per denomination is processed in an individualized fashion for the first four counter clerks and then in a second individualized processing operation the cash for the two remaining counter clerks is processed in an individualized fashion into the output compartments 6*b* and 7*b*.

In this case, after the respective data has been input into the database of the control unit 15 in order to prepare the individualized processing, the memory of the control device 15 would thus contain, as additional information, data relating to the number of individualized processing runs (one in the case of three counter clerks, two in the case of six counter clerks) or information as to which banknotes are to be deposited in which compartment during which run.

The individualized processing would thus not be terminated after a sorting run in step 2 but rather a second individualized processing run or even a plurality of individualized processing runs, in which the cash is processed in an individualized fashion for the fourth and fifth counter clerks, would also be carried out in an analogous fashion. This procedure consequently also makes it possible for the individualized processing to be carried out in a simple way for a larger number of counter clerks which exceeds the number of output compartments (in the present case the four output compartments 6*b*, 7*b*, 8*b*, 9*b*) which are available for the individualized processing.

In addition, there is a description above of the case in which the features of the identifier of the individual output compartments, i.e. the specification of the intended receivers and the number of banknotes per denomination, is input by the operator into the software module 15 by means of the input keyboard 19 during the first step of the preparation of the individualized processing operation. Alternatively, it is of course also conceivable for at least some of this data to be already stored in advance in the control unit 15. This stored data could possibly be data from preceding use processes.

One possibility, is, for example, that a central computer feeds the banknote orders of customers to the control unit 15 via the remote transmission of data and this data is then converted by software control into suitable identifiers, i.e. individualized processing operations, for the apparatus 1. As, in this case, the identifying data no longer has to be input manually by an operator using the input device 19, this leads to a further simplification of the method sequence.

In this context, the individualized processing can be optimized further by recording and storing the identifying data of the individualized processing operations, i.e. in particular the features of the identifier of the individual output compartments, over a relatively long time period so that conclusions can be drawn on the volume of demand from specific receivers, for example of the individual counter clerks. The stored data can be evaluated by means of software statistics in order to acquire information on fluctuations in volume or the like which are specific to weekdays or times of the year so that on this basis proposals for the individualized processing can be automatically generated.

Alternatively, the following is also conceivable: whereas in the embodiment described above, the identifying data is collected for the purpose of information and displayed on an individual monitor 17, it is additionally or alternatively also conceivable for in each this data to be displayed separately for the respective compartment in the region of the individual output devices 6, 7, 8, 9, 10 so that an incorrect assessment of the assignment of the identifying data to the individual output compartments is less probable and the operating reliability is increased.

This visual display of the identifying features in the direct vicinity of the individual output compartments is also particularly appropriate if the banknotes are removed manually by the operator after the individualized processing run and passed onto the respective receiver or else intermediately stored in advance. In such a case, the user for which the banknotes which have just been processed in an individualized fashion are intended is readily apparent to the operator at all times.

It is to be noted that, however, in the case in which the operator is capable of making the assignment of the outputting of the banknotes of the individual compartments to specific users (counter clerks) in a different way, this data would neither have to be visually displayed nor even specified and stored as part of the identifier.

Furthermore, whereas there was a description above of the case in which, before being passed on, the banknotes input into the input compartment are to pass through the individual output compartments of the checking device so that they are checked for value and authenticity, these checks are not absolutely necessary.

If the operator has already convinced himself of the authenticity of the banknotes in some other way, the authenticity check is for example not necessary. In addition, if, in the case specified above, in each case only banknotes of a single denomination, i.e. at first only 50 DM banknotes and later only 100 DM banknotes, are input into the input compartment, it is possible to dispense with a denomination detection process.

However, this denomination detection process is particularly advantageous if a bundle of banknotes with mixed denominations is input into the input compartment 2 for individualized processing. Instead of a situation, for example as in the previously described specific example of the individualized processing for three counter clerks, in which at first the 50 DM notes are input into the input compartment 2, the desired predetermined number of said notes is then automatically deposited in the individual output units 6, 7, 8 and only afterwards are the 100 DM notes input into the input compartment 2 for further individualized processing, the following process, for example, is also conceivable.

Even before the sorting run is carried out, the operator can insert a bundle of banknotes into the input compartment 2 which contains both 50 DM and also 100 DM banknotes. In particular in the case in which the bundle of banknotes which has been input in this way already contains more banknotes of the individual denominations than are to be processed in an individualized fashion into the output compartments according to the specifications of the control unit 15, this permits simpler operation and allows time to be saved as the operator has to insert in each case an individual, separate bundle of banknotes for sorting into the input compartment 2 only once at the start of the sorting run, and not repeatedly, i.e. for the banknotes of each denomination.

As mentioned above, a particular advantage of the present invention is that the properties according to the invention can easily be retrofitted by means of software into certain, already known banknote sorting machines, such as the "BPS 200" from the applicant, in a way which saves costs.

In addition to a saving in costs, this possibility of retrofitting using software also permits the control units to be configured in such a way that, in addition to the processing mode according to the invention of processing in an individualized fashion, it is also possible to carry out the deposit processing which is known per se and in which the banknotes which have been input are separated according to criteria such as the denomination, frequency of circulation, authenticity or the like. This possibility leads to a significant expansion of the range of application of banknote processing machines.

The device according to the invention and the method according to the invention thus make it possible for rapid and reliable processing of banknotes in an individualized fashion, supported by automatic means, to be carried out in a way which can also be implemented easily and cost-effectively on the basis of the already existing technologies of banknote processing systems.

The invention claimed is:

1. A device for sorting bank notes, comprising:

an input compartment adapted to hold bank notes of different denominations which are to be sorted, a plurality of output compartments adapted to receive sorted bank notes, a conveying system arranged to convey bank notes from the input compartment to one of the output compartments, the compartment being selected in response to signals from a control device, wherein the control device is configured to output the signals to the conveying system on the basis of different predefined denominations and numbers of bank notes designated for each of at least two of the plurality of the output compartments so that bank notes of a plurality of different denominations input into the input compartment are automatically sorted directly into the output compartments so that each of the at least two output compartments receive the respective different predefined denominations and numbers of bank notes designated for the respective at least two of the plurality of output compartments; and wherein the control device comprises a memory for storing at least some components of an identifier, and the control device is configured to generate, on the basis of the components stored from at least one previous individualized processing operation, proposals for an identifier of an individualized processing operation which is still to be carried out;

wherein a selected one of the proposed identifiers is utilized by the control device to determine into which output compartment the bank notes are to be output.

2. A method for retrofitting an existing banknote processing device for sorting bank notes, the method comprising:

providing an input compartment for holding bank notes of different denominations to be sorted, a plurality of output compartments adapted to receive sorted bank notes, a conveying system for conveying the bank notes from the input compartment to one of the output compartments, the compartment being selected in response to signals from a control device:

configuring the control device to output the signals to the conveying system on the basis of different predefined denominations and numbers of bank notes designated for each of at least two of the plurality of the output compartments so that bank notes of a plurality of different denominations input into the input compartment are automatically sorted directly into the output compartments so that each of the at least two output compartments receive the respective different predefined denominations and numbers of bank notes designated for the respective at least two of the plurality of output compartments;

wherein the control device comprises a memory for storing at least some components of an identifier, and the control device is configured to generate, on the basis of the components stored from at least one previous individualized processing operation, proposals for an identifier of an individualized processing operation which is still to be carried out;

wherein a selected one of the proposed identifiers is utilized by the control device to determine into which output compartment the bank notes are to be output.

* * * * *